United States Patent [19]

Dittrich et al.

[11] 4,059,453

[45] Nov. 22, 1977

[54] METHOD OF MAKING MOLDS FOR THE CASTING OF METALS

[75] Inventors: Werner Dittrich, Herten, Baden; Friedhelm Schnippering, Troisdorf, both of Germany

[73] Assignee: Dynamit Nobel Aktiengesellschaft, Troisdorf, Germany

[21] Appl. No.: 685,556

[22] Filed: May 12, 1976

Related U.S. Application Data

[63] Continuation of Ser. No. 510,831, Sept. 30, 1974, abandoned.

[30] Foreign Application Priority Data

Oct. 3, 1973 Germany ..... 2349593

[51] Int. Cl.[2] ..... B28B 7/34

[52] U.S. Cl. ..... 106/38.3; 106/38.35; 106/38.5 R; 106/57; 106/65; 106/66; 106/69; 164/16; 164/26; 164/40

[58] Field of Search ..... 106/38.3, 38.35, 38.2, 106/38.22, 38.9, 57, 65, 66, 69, 38.5 R; 164/16, 26, 40

[56] References Cited

U.S. PATENT DOCUMENTS

| | | | |
|---|---|---|---|
| 2,806,270 | 9/1957 | Shaul | 106/38.3 |
| 2,945,273 | 7/1960 | Herzmark et al. | 106/38.3 |
| 3,537,949 | 11/1970 | Brown et al. | 106/38.3 |
| 3,598,617 | 8/1971 | Bockstie | 106/38.35 |
| 3,854,961 | 12/1974 | Flasch | 106/38.3 |

*Primary Examiner*—Lorenzo B. Hayes

*Attorney, Agent, or Firm*—Burgess, Dinklage & Sprung

[57] ABSTRACT

An improvement in a process for making a mold for metal casting by applying a fluid ceramic composition containing binding agent and finely divided refractory substance to a pattern and hardening the same, which improvement comprises employing a ceramic composition which contains special solvents, anti-setting and thixotropic agents, so that this composition after applying gives a uniform coat which does not run down from walls.

19 Claims, No Drawings

METHOD OF MAKING MOLDS FOR THE CASTING OF METALS

This is a continuation of application Ser. No. 510,831, filed Sept. 30, 1974, now abandoned.

BACKGROUND OF THE INVENTION

1. Field of the Invention

This invention relates to an improved process for obtaining molds for metal castings, especially molds of large dimension. This invention is directed to a process for making a mold which not only can be employed in making metal castings of large dimensions, but can be employed in making metal castings of high dimensional accuracy. This invention is directed to, additionally, a ceramic composition for use in making molds for metal castings which ceramic composition comprises a binding agent, finely divided refractory material anti-setting and thixotropic agents and special solvents.

2. Discussion of the Prior Art

Numerous attempts have been made to prepared molds for metal castings. In German Pat. No. 942,340 there is described a process for making molds wherein crushed refractory substance are used together with a binder such as one based on an alkyl silicate. Molds made in accordance with the process therein described, however, do not satisfy requirements with respect to dimensional accuracy. Additionally, such molds are only suitable for making castings of small dimensions. It has, therefore, become desirable to provide a method for making molds to be employed in the manufacture of metal castings of high dimensional accuracy and of large dimensions.

There is described another process for the manufacture of molds in Foundry Trade Journal of Mar. 3, 1960 under the title "Composite Mould Process". In the process therein disclosed two different ceramic molding materials are used: grog with a water glass binder for making a supporting mold and a fluid ceramic slip consisting of a crushed refractory material, a binding agent and a hardener. The grog mold is initially made on a preliminary pattern which is approximately 1 to 2 cm. larger in all dimensions than the actual pattern. The grog mold is fired at 650° C. The same is provided with a hole in the center and it is placed over the actual pattern and the slip is poured through the hole into the clearance between the pattern and the preliminary form. The cast layer constitutes the lining which comes in contact with the molten metal during casting. The disadvantage of this process lies in the occurrance of air bubbles in the poured slip often resulting in surface flaws. Obviously, several operations are required in the manufacture of the mold, i.e., the formation of a grog mold, the disposition of the grog mold over the actual pattern and the filling of the clearance between the grog mold and the actual pattern, all consuming time and money.

To eliminate the disadvantages of that process it was proposed in German Offenlegungsschrift No. 1,965,446 first to coat the pattern with a thin fine coating and then to sprinkle coarse granular material on the coating while it was still wet, i.e., before it had fully set and then to draw a preliminary form over the coated pattern. The preliminary form would, of course, be 1 to 2 cm. larger in all dimensions than the pattern. A ceramic slip would then be poured into the clearance. Since in the practice of this process at least four operations are necessary it consumed too much time and effort. It was also impractical for the manufacture of metal castings of large dimensions.

In the periodical, "Giesseri", 50, p. 661 (1963), a ceramic molding process is described in which a divided pattern is repeatedly dipped into a ceramic slip. In this manner a thin-walled ceramic shell mold is formed on the pattern. The process is, however, limited to the production of molds of relatively small dimensions. It is not useful for the manufacture of castings having steep descending walls.

In the periodical "Gray and Ductile Iron News" of October 1966 there is described another process for the manufacture of molds wherein colloidal silica is employed as binding agent. A ceramic shell is formed which is provided with a supporting shell. Unfortunately, this process also is limited to the preparation of molds of small dimensions.

Hence, none of the methods thus far provided have been simple in nature and yet able to prepare molds for the manufacture of metal castings of large dimensions, especially those having steeply descending outer walls, say, those having a pitch of at least 90°. Attempts have, indeed, been made to use sprayable compositions before the ceramic coating comes in contact with the metal and to thereafter sand these compositions. Such sand compositions, however, have proven to be impractical for the preparation of ceramic coatings on patterns with vertical or steep outer walls, especially outer walls having a pitch of at least 90°. On account of their relatively low viscosity they run down the steep walls and become accumulated at the bottom. The viscosity can be increased by increasing the percentage of the highly refractory substances, but this does not solve the problems because even such more viscous materials tend to sag and run down the walls.

It, therefore, became desirable to provide a process for the manufacture of a mold suitable for metal castings which could be simply performed, could prepare molds having large dimensions and would be useful particularly in the preparation of castings having vertically disposed or steeply descending outer walls, especially those having a pitch of at least 90°. It became especially desirable to provide a process for the manufacture of a mold useful in metal casting whereby the mold would provide great dimensional accuracy for the metal casting.

SUMMARY OF THE INVENTION

The objects of the present invention are accomplished by an improved process for making a mold for metal castings by applying a fluid ceramic composition containing a binding agent and finely divided refractory substance to a pattern and hardening the same, the improvement comprising employing a ceramic composition which contains special solvents anti-setting and thixotropic agents.

It has been discovered, pursuant to the present invention, that by including anti-setting and thixotropic agents in a ceramic composition containing binding agent and finely divided refractory substance that large dimensioned molds can be prepared, even molds having vertically disposed or steeply descending outer walls of pitch of at least 90°. The use of the anti-setting and thixotropic agents, help to hold the dissolved binding agent and finely divided refractory substance to the walls of the pattern so that the same do not run or sag. Thereafter, the hardening forms the material into the precisely desired shape corresponding to the pattern.

The ceramic composition of the present invention is one which is fluid at room temperature as the fluid ceramic composition containing anti-setting and thixotropic agent is applied directly to the mold pattern by the use of known applicator tools, especially those in which the fluid is applied to the pattern with a force. The composition is applied by methods known in the painting and plastering art, e.g., centrifugal methods, or, for example, spraying. Other methods in which the fluid ceramic composition is applied to the pattern by use of pressure can also be performed.

In carrying out the present invention the fluid ceramic composition is first applied to the pattern. Thereafter the ceramic composition is hardened. However, following application of the fluid ceramic composition to the pattern and prior to hardening the composition prior to hardening, i.e., prior to hardening to final hard consistency there can be applied to the ceramic composition on the mold in a separate stop a sand coating. This sand coating or "stuccoing" can be carried out with a granular refractory substance. If desired a plurality of fluid ceramic coatings can be applied to the pattern and following each application of fluid ceramic coating composition there can be added additional coats of sand. Generally speaking, when there is added to the ceramic composition on the pattern, prior to hardening, a granular refractory substance the same is applied in such an amount that the total surface of the wet seat of the ceramic composition is covered. The purpose in utilizing a plurality of ceramic composition layers and sandings is to build up the thickness of the mold to the desired level. Thereafter, the ceramic composition is hardened as described below.

Although the anti-setting and thixotropic agent can be present in the ceramic composition over a wide range they are generally present in an amount between 0.1 and 10 weight percent, preferably between 0.5 and 2 weight percent, based upon the weight of the entire ceramic composition. The ceramic composition itself generally comprises the following agents:

TABLE 1

| Component | Broad Range | Preferred Range |
|---|---|---|
| Binder | 5 to 50 | 20 to 30 |
| Refractory Oxide | 50 to 95 | 70 to 90 |
| Anti-Settling and agent Thixotropic | 0.1 to 10 | 0.5 to 2 |
| Solvents | 5 to 50 | 10 to 20 |

DESCRIPTION OF PREFERRED EMBODIMENTS

In the practice of the present invention is used a partially condensed alkyl silicate containing hydroxyl groups or alcoholate, partially condensed, if desired, of aluminum, zirconium or titanium, or mixtures of these compounds, as the binding agent. The binding agent is dissolved in an inert organic solvent and contains the anti-settling and thixotropic agents before it is added to the refractory metal oxide to form the ceramic composition. Alcohols are preferred as inert organic solvents, especially those alcohols which are fluid at room temperature and whose boiling point is above 120° C, such as, for example, ethylene glycol monomethyl ether or diacetone alcohol. High boiling alkanols, especially monoalcohols are also particularly contemplated, these having boiling points above 120° C. In this connection it is preferred to maintain the binder in the form of a solution to avoid any undesired excessive rapid drying and, solidification of ceramic composition when sprayed on to the mold. It is desired that hardening not take place immediately so as to provide ample time for the stuccoing of the ceramic coating, if desired. The solvent is employed in an amount between 5 and 50%, preferably between 10 and 30%, by weight of the binding agent.

The term "partially condensed alkyl silicate containing hydroxyl groups," as used herein, is to be understood to refer to a compound containing an average of up to 10 SiO groupings, which contains randomly distributed ester groups and hydroxyl groups. Such compounds can be prepared by the known partial hydrolysis of a partially condensed alkali silicate, such as, for example, the so-called "Ethyl Silicate 40" or Dynasil 40. The alkyl radicals of the alkyl silicates used in accordance with the invention preferably have between 1 and 8 carbon atoms in the chain.

Especially suitable for the purpose of the invention are those products whose $SiO_2$ content is between 8 and 35, and preferably between 18 and 25%, by weight. These compounds pertain to the state of the art, and their preparation is not subject matter of the present invention.

Compounds such as those already named in U.S. application Ser. No. 326,624 have been used as alcoholates of aluminum, zirconium or titanium. Mixtures of these alcoholates with one another and with, in some cases, the above-named partially condensed alkyl silicates, can also be used.

The ratio of the liquid compound (that means binding agent, solvent plus the added anti-settling and thixotropic agents) to the dry refractory material is advantageously so adjusted that the ceramic composition will on the one hand have a sprayable or centrifugeable consistency, as the case may be, and on the other hand will adhere to steep pattern walls without sagging. The above amounts generally reflect the proper relationship between these components, it being realized that considerations should be given to the physical and chemical characteristic of each component.

Mixtures are suitable, for example, in which the ratio of the liquid component to the refractory substance is from 1:4 to, for example 1:6.

Departures from these ratios are possible, since the optimum flow characteristics and setting characteristics of the ceramic composition used in accordance with the invention depend not only on the nature and quantity of the binding agent used and those of the anti-settling and thixotropic agents, and the solvent, but also on the specific surface area of the highly refractory granules used.

The finely divided, refractory substances to be used for the purpose of the invention are known refractory oxides or silicates, such as for example electrofusion products on the basis of aluminum oxide, silicon dioxide, zirconium oxide, mullite or the like, or minerals such as, for example, zirconium silicate, sillimanite, chromium-containing sands or quartz sand, or other such substances, as the sole component or in mixtures with one another.

Heretofore, it has been customary to use for the coating coming in contact with the molten metal substances having a grain size ranging between 0 and about 0.07 mm, and then, for the purpose of avoiding cracks in the refractory coating, sanding the still soft coating with dry, refractory material having a grain size range between 0.12 mm. and 1 mm.

In the process of the invention it was surprisingly found that mixtures of fine grits, e.g., 100 to 200 (Tyler) mesh and coarse grits 14 to 32 (Tyler) mesh in a fine to coarse grit volume rates of 1:1 to 2:1 can be used in making the refractory coating if the ceramic composition contains anti-settling and thixotropic agents. Unexpectedly, in such compositions no separation of the refractory substance and the liquid binding agent takes place either in the tools used in their application or in the applied passes. It also has been found that, in this preferred embodiment of the invention, no after-sanding of the coating while still soft is necessary.

As finely divided refractory substances in the ceramic composition to be used in accordance with the invention, mixtures of grain sizes according to Fuller's or Litzow's grain size distribution curves are used (cf. "Feuerfestkunde," F. Harders and S. Kinow, Springer-Verlag, Baden, Gottingen, Heidelberg, 1960, pp. 78 sqq.).

Substances are used as anti-settling and thixotropic agents which are known in the painting art as thixotropic or thickening agents. Preferred substances are those on the basis of montmorillonite, bentonites preferably swollen with organic solvents such as, for example, a mixture of xylene and ethanol, or organic montmorillonite derivatives; pyrogenic silica; asbestos flour or filaments; cellulose esters such as ethyl cellulose, for example, or cellulose ethers; resinous products of hardened castor oil, talc, mica, or mixtures of these substances or substances of similar structure. The amount of these agents to be added may vary widely according to the density or the nature and quantity of the refractory substance and of the binding agent plus solvent.

The fluid composition to be used in accordance with the invention is solidified after application. Solidification takes place chemically by means of a hardening agent if binding agents on a silicon or aluminum basis are used. The hardening agent can be added to the fluid mass. Use is made preferably or primary, secondary or tertiary amines, in the form, in some cases, of their solutions in alcohol or water, for example, preference being given to triethanolamine, an aqueous ammonia solution, or a basically reacting metal oxide such as MgO, for example. The applied coating can also be hardened after application by using a gaseous hardener, such as ammonia, for example.

If zirconium or titanium compounds are used, the use of a hardener is not necessary.

In the making of casting molds the procedure may be, for example, as follows: First a relatively thin coating of the ceramic composition is sprayed, for example, by means of a spray gun onto a divided pattern, and immediately thereafter a granulated refractory substance, such as calcined kaolin or mullite refractory, is sprinkled onto the still soft, i.e., not fully hardened composition. If necessary, one or more additional coats are applied in the same manner, until a desired thickness is reached. In this manner it is possible, for example, to make shell molds having a wall thickness of 1 cm. or more. After the halves of the shell mold have set they are removed from the pattern and subjected to a heat treatment, after assembly with the corresponding upper portion, if desired. Then the mold is placed in a foundry flask, and the gap between the flask wall and the mold is filled up with steel shot, for example. Then the casting can be performed. After the teeming has been completed, the steel shot backfill can easily be removed.

In a preferred embodiment of the invention, the procedure may be first to spray on a thin layer of the ceramic composition, then sand it, and immediately thereafter spray on another coat. Immediately after application of the second coat, the second, still soft coating is provided with a supportive backfill, for example by ramming with a composition of, for example, water glass-bonded quartz sand or grog. The supporting mold thus obtained is then hardened with carbon dioxide. After the ceramic coating has set, the pattern can be removed and the entire mold can be solidified by the action of heat. This can be accomplished by air drying or oven drying, by firing with a gas flame, or by igniting a combustible substance, such as acetone, which has been poured over the mold.

The molds made by the method of the invention may be used advantageously for making castings of steel, iron, copper, aluminum, zinc, etc., or of alloys, where great dimensional accuracy and high surface quality are required. They are especially well suited for making castings having textured surfaces, such as corrugations, wood graining, leather graining, etc., and for the production of castings of large dimensions.

In order to more fully illustrate the nature of the invention and the manner of practicing the same, the following examples are presented.

EXAMPLE 1

694 g of partially hydrolyzed ethyl silicate 40, which is commercially obtainable under the name Dynasil® 40, having a content of 20% $SiO_2$ by weight, was mixed with 56 g of a paste on the following basis:

- 10 wt. parts dimethyl-dioctadecyl-ammonium-montmorillonite,
- 10 wt. parts benzine,
- 10 wt. parts of an electroneutral wetting agent, suspending agent and dispersant based on a salt of long-chained polyaminamides and an acid ester of high molecular weight, obtainable commercially under the name Anti-Terra-U. 35 ml. of 50% aqueous triethanolamine solution was added as hardener.

This mixture was stirred together with the following refractory substances to form a slip and was spun onto a prepared pattern half by means of a centrifugal apparatus known in the plastering art:

- 2.6 kg. zirconium silicate flour (grain size 0 to 0.07 mm)
- 0.4 g ground electric furnace mullite refractory (grain size 0.12 to 0.25 mm),
- 0.6 kg. ground electric furnace mullite refractory (grain size 0.25 to 0.5 mm),
- 1.1 kg. ground electric furnace mullite refractory (grain size 0.5 to 1 mm).

Granular grog containing 8% water glass by weight as binding agent was rammed onto the still soft, approximately 1 cm. thick layer, in a thickness of about 10 cm., and was hardened with carbon dioxide.

The grog layer can be reinforced, if desired, with iron bars.

After the fine coating had dried and the pattern half had been removed, acetone was poured over the mold half and ignited. After the mold half had burned out it was joined to a top. The completed mold was filled with molten GS 42 CrMo 4 steel, and yielded a casting of high dimensional accuracy and a very smooth surface.

EXAMPLE 2

30 weight parts of a partially hydrolyzed ethyl silicate 40 as in Example 1 ($SiO_2$ content 20%) containing 7.5%, by weight, of the same montmorillonite-base paste as in Example 1, 65 weight parts of finely divided calcined kaolin (grain size 0 to 0.07 mm.) and 1.5 weight parts of 50% aqueous triethanolamine solution were stirred to form a slip which was sprayed with a spray gun onto a prepared pattern half.

Immediately thereafter, granular calcined kaolin (grain size 0.12 to about 1 mm.) was sprinkled on. Directly thereafter another coat was sprayed on, so that the total coating thickness amounted to 2 to 3 mm. Onto the still soft coating, granular grog containing 8 weight percent water glass as binding agent was rammed on in a thickness of about 10 cm. and hardened with carbon dioxide. After the fine layer had set and the pattern half had been removed, the mold thus produced was further treated as in Example 1.

An aluminum-silicon alloy was poured into the finished mold and yielded a casting of high dimensional accuracy and a very smooth surface.

EXAMPLE 3

20 weight parts of partially hydrolyzed ethyl silicate 40, as in Example 1 ($SiO_2$ content 20% by weight), containing 7.5%, by weight, of a montmorillonite paste as in Example 1, 50 weight parts of a zirconium silicate flour (grain size 0 to 0.7 mm.), 30 weight parts of mullite refractory (grain size 0.12 to 0.25 cm.), 1.0 weight parts of a 50% aqueous solution of triethanolamine, were mixed together and sprayed onto a pattern half. Mullite refractory of a grain size of 0.5 to 1 mm. was used to sand the first coat. After the second coat was sprayed on, the same procedure was followed as in Example 2.

The mold halves were assembled after flame treatment and heated in a furnace to 900° C. Then a commercial chromium-molybdenum steel was cast in the mold. A casting was obtained which was flawless in every regard and had a very smooth surface.

EXAMPLE 4

10 weight parts of zirconium tetra-n-butylate containing 7.5 weight percent of a montmorillonite-base paste as in Example 1, 10 weight parts of electric furnace zirconium oxide of 0 to 0.06 mm. grain size, and 10 weight parts of electric furnace zirconium oxide of 0.06 to 0.12 mm. grain size were stirred together to form a slip which was sprayed onto a pattern half. Immediately after spraying, the coating was sanded with the same zirconium oxide of 0.25 to 0.5 mm. grain size.

After the prime coat had dried, a shell about 1 cm. thick was built up by the application of slip as in Example 1. After the shell had hardened, it was dried, and the pattern half was removed after about ½ hour. The shell mold halves were then assembled with the corresponding top and fired at 1000° C. After firing the mold was placed in a flask and the space between the flask and the mold was filled up with steel shot. A mold made by this method was used in casting chromium-nickel-silicon steel and yielded a flawless casting with a very smooth surface.

Generally speaking, each layer of ceramic coating on the pattern is between 1 and 15 mm. in thickness. The final mold can have a wall thickness of between 3 and 20 cm., preferably between 5 and 15 cm. by the application of a plurality of coatings of ceramic composition and by the use of the intermittent sanding, if desired.

What is claimed is:

1. In a process for making a multilayer mold comprising applying to a foundry mold form a first ceramic composition containing a refractory aggregate and a binder selected from the group consisting of an alcoholate of titanium, aluminum or zirconium and an alkyl silicate, hardening said first ceramic composition on said mold form to form a first layer and adding onto said first layer before said first layer has fully hardened a second ceramic composition in the form of a supportive backfill and hardening said second ceramic composition, the improvement comprising as said first ceramic composition, A. A first refractory material of grain size 100 to 200 (Tyler) mesh and a second refractory material of 14 to 32 (Tyler) mesh, the volumetric ratio of said first refractory material being 1–2 : 1 and;

B. An anti-settling agent in an amount between 0.1 and 10 weight percent, said anti-settling agent selected from the group consisting of montmorillonite, bentonite, pyrogenic silica, asbestos flour, asbestos filaments, ethylcellulose, talc and mica.

2. A process according to claim 1 wherein said first ceramic composition is fluid and contains a solvent for said binder.

3. A process according to claim 2 wherein said solvent is an alcohol having a boiling point above 120° C.

4. A process according to claim 2 wherein said solvent is selected from the group consisting of ethylene glycol monomethyl ether and diacetone alcohol.

5. A process according to claim 3 wherein the refractory aggregate of said first ceramic composition is selected from the group consisting of aluminum oxide, silicon dioxide, zirconium oxide, mullite, zirconium silicate, sillimanite, chromium-containing sand and quartz sand.

6. A process according to claim 5 wherein said first ceramic composition contains 5–50 weight percent of said binder, 50–95 weight percent of said refractory aggregate and 5–50 weight percent of said solvent.

7. A process according to claim 6 wherein said anti-settling agent is present in said first ceramic composition in an amount of between 0.5 and 2 weight percent.

8. A process according to claim 7 wherein said binder is present in an amount of 20–30 weight percent, said refractory material is present in an amount of 70–90 weight percent and said solvent is present in an amount of 10–20 weight percent.

9. A process according to claim 1 wherein said second ceramic composition comprises water glass and quartz sand.

10. A process according to claim 1 wherein said second ceramic composition comprises water glass and grog.

11. A process according to claim 1 wherein said second ceramic composition is hardened by applying carbon dioxide gas thereto.

12. A process according to claim 6, wherein said first ceramic composition contains a primary, secondary or tertiary hardening agent.

13. A process according to claim 1 wherein said binder is a partially condensed alkyl silicate whose alkyl radicals have between 1 and 8 carbon atoms in the chain.

14. A process according to claim 12 wherein said binder has an $SiO_2$ content of between 8 and 35% by weight.

15. A process according to claim 13 wherein said binder has an $SiO_2$ content of between 18 and 25 percent by weight.

16. A process according to claim 1 wherein said first layer is hardened by an aqueous ammonia solution.

17. A process according to claim 1 wherein said anti-settling agent is a montmorillonite or bentonite swollen with an organic solvent.

18. A process according to claim 1 wherein said anti-settling agent is montmorillonite swollen with a mixture of xylene and ethanol.

19. A process according to claim 1 wherein prior to the time said first layer has fully hardened there is applied thereto sand.

* * * * *

UNITED STATES PATENT AND TRADEMARK OFFICE

CERTIFICATE OF CORRECTION

PATENT NO. : 4,059,453

DATED : November 22, 1977

INVENTOR(S) : Dittrich et al

It is certified that error appears in the above-identified patent and that said Letters Patent are hereby corrected as shown below:

Column 3, line 27, "seat" should read -- coat --.

Column 3, line 45, delete "agent" and insert -- agents -- after "Thixotropic".

Column 4, line 5, "30%" should read -- 20% --.

Signed and Sealed this

Ninth Day of May 1978

[SEAL]

Attest:

RUTH C. MASON
Attesting Officer

LUTRELLE F. PARKER
Acting Commissioner of Patents and Trademarks